United States Patent [19]

Hadtke

[11] Patent Number: 4,844,263

[45] Date of Patent: Jul. 4, 1989

[54] FOOD CONTAINER

[75] Inventor: Frederick Hadtke, New Providence, N.J.

[73] Assignee: Hercules, Incorporated, Wilmington, Del.

[21] Appl. No.: 158,291

[22] Filed: Feb. 19, 1988

[51] Int. Cl.[4] ..... B65D 21/00; B65D 85/62

[52] U.S. Cl. ..... 206/508; 206/509; 206/511; 220/236; 220/359; 220/377

[58] Field of Search ..... 206/509, 511, 512, 508

[56] References Cited

U.S. PATENT DOCUMENTS

| | | | |
|---|---|---|---|
| 3,244,311 | 4/1966 | Lawson . | |
| 3,586,201 | 6/1971 | Ebert | 220/9 |
| 3,616,943 | 11/1971 | Brink . | |
| 3,620,411 | 11/1971 | Rump | 220/315 |
| 3,815,736 | 6/1974 | Sedlak . | |
| 4,061,241 | 12/1977 | Retelay . | |
| 4,215,797 | 8/1980 | Chen | 220/359 |
| 4,742,933 | 5/1988 | Panick | 220/69 |

FOREIGN PATENT DOCUMENTS 169737A 7/1984 European Pat. Off. .

*Primary Examiner*—David T. Fidei

*Assistant Examiner*—Gilbert Reece

*Attorney, Agent, or Firm*—Connolly & Hutz

[57] ABSTRACT

A food container comprises top and bottom members, with the bottom member including a lower base wall and an upwardly extending side wall. Spaced apart downwardly extending depressions are formed in the lower base wall, and each of these depressions has an inside wall surface spaced inwardly from the surrounding side wall. The inside wall surfaces of the depressions collectively define an outline, and the top member has a raised central portion the outline of which is substantially identical to but slightly smaller than the outline defined by the depressions. This relationship enables the raised central portion of the top lid member to interlockingly fit between the depressions when assembled food containers are stacked one above the other. The raised central portion of the top lid member has less height than the depressions which spaces the lower base wall from the raised central portion when assembled containers are stacked. As a result, open passageways are provided between the spaced apart depressions, the lower base wall of the bottom member and the raised central portion of the top member which may include vent openings therein.

14 Claims, 2 Drawing Sheets

FOOD CONTAINER

BACKGROUND OF THE INVENTION

The present invention relates to a food container, and more particularly to a food container with vent holes therein interlockingly stackable with other containers of similar configuration.

Numerous food containers have been proposed over the years fabricated from a variety of different and diverse materials. In the packaging of fresh produce, it is important that essentially closed containers allow proper flow of chilled air around the container to maintain the contents fresh, particularly when these containers are stacked one above the other for storage and display. Equally important with essentially closed food containers is provision for the flow of gases to and from the container as well as control of interior water vapor levels and vapor pressures. Proper attention to these parameters produces containerized food having an attractive and fresh appearance over long periods of time.

SUMMARY OF THE INVENTION

Accordingly, it is an object of the present invention to provide a food container having structural features that enable containers of generally similar configuration to be stacked in interlocking relationship one above the other while providing open passageways around the container for the flow of gases.

Another object of the present invention is a food container which maintains the packaged food in an attractive and fresh state over long periods of time.

Still another object of the invention is a food container which is simple in design and easy to manufacture.

In accordance with the present invention, a food container comprises a bottom member and a top lid member constructed and arranged to cover the bottom member when the members are assembled. The bottom member includes a lower base wall with an upwardly extending side wall surrounding the base wall, and a plurality of spaced apart downwardly extending depressions are formed in the lower base wall. Each of the depressions has an inside wall surface spaced inwardly from the surrounding side wall of the bottom member and these surfaces collectively define a particular outline. The top lid member includes a raised central portion having an outline substantially identical to but slightly smaller than the one defined by the inside wall surfaces of the depressions, and this relationship enables the raised central portion of the top lid member to interlockingly fit between the depression when assembled food containers are stacked one above the other. Vent openings are located in the raised central portion of the top lid member. It is significant that the raised central portion has less height than the depressions since this relationship spaces the lower base wall of the bottom member from the raised central portion of the top lid when the food containers are stacked. As a result, open passageways are provided between the spaced apart depressions, the lower base wall of the bottom member and the raised central portion of the of lid member with the plurality of vent openings therein.

Preferably, the raised central portion of the top lid member includes a depressed area, and the vent openings are located inn that area.

Moreover, the lower base wall of the bottom member may be generally rectangular in configuration with the spaced apart downwardly extending depressions therein positioned at the corners, one at each of the four corners thereof. In this arrangement, each of the depressions preferably has an L-shape.

The top lid member may include an upwardly extending dome with the raised central portion extending upwardly from the dome. Moreover, the outline of the raised central portion and the outline collectively defined by the inside wall surfaces of the depressions may be rectangular.

The bottom and top lid members preferably include outwardly extending and mutually engaging peripheral rim flanges. The rim flanges may be releasably connected together by a heat seal or alternatively by adhesive. Also, each of the rim flanges may include a separation to facilitate removal of the top lid member from the bottom member when desired.

In the preferred embodiment, the bottom and top lid members may be fabricated from transparent polyvinyl chloride.

BRIEF DESCRIPTION OF THE DRAWING

Novel features and advantages of the present invention in addition to those noted above will become apparent to persons of ordinary skill in the art from a reading of the following detailed description in conjunction with the accompanying drawing wherein similar reference characters refer to similar parts and in which.

DETAILED DESCRIPTION OF THE INVENTION

Figure 3:
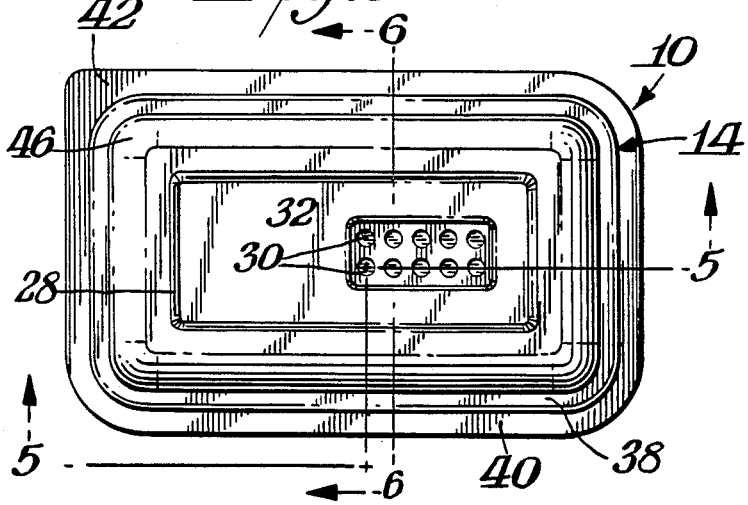
FIG. 3 is a top plan view of the food container shown in FIG. 1.

Referring in more particularly to the drawing, FIGS. 1–4 illustrate a food container 10 comprising a bottom member 12 and a top lid member 14 arranged to cover the bottom member when the container is assembled as shown. Food container 10 may be fabricated from transparent polyvinyl chloride by techniques known in the art such as molding, stamping and pressing, for example. Also, other materials are equally suitable although polyvinyl chloride is preferred. Moreover, it should also be pointed out that the top lid and bottom members are manufactured with appropriate draft angles so that each of these members is nestable with members of like configuration. Hence, prior to assembly, bottom members 12 may be stored in a nestable stack and top lid members 14 may be similarly stored.

Figure 4:
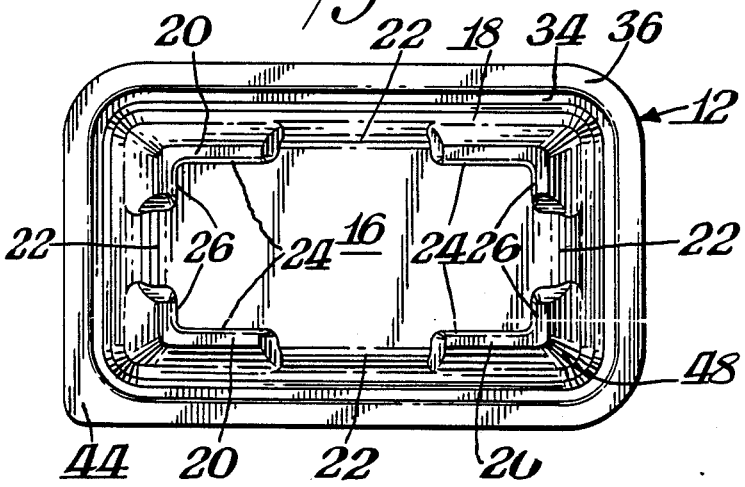
FIG. 4 is a bottom plan view of the food container shown in FIG. 1.

Bottom member 12 includes a lower base wall 16 and upwardly extending side wall 18 which surrounds the base wall. As best shown in FIG. 4, a plurality of spaced apart downwardly extending depressions 20 are positioned in the lower base wall of bottom member 12. In the embodiment illustrated, the lower base wall has a generally rectangular configuration and the spaced apart downwardly extending depressions 20 are positioned at the corners of the base wall, one at each of the four corners thereof. In this arrangement, each of the depressions is L-shaped in form with one leg running along the side of the container and the other leg running along the end thereof. Open spaces 22 are provided between the depressions 20, and these openings define passageways to the underside of the food container, as explained more fully below. Depressions 20 form container feet as is clear from FIGS. 1 and 2 of the drawing.

Each of the depressions 20 has inside wall surfaces 24,26 inwardly spaced from surrounding side wall 18 of bottom member 12. Inside wall surfaces 24 are aligned with the sides of food container 10 while wall surfaces 26 run along the ends of the food container. As shown best in FIG. 4, the inside wall surfaces 24, 26 of depressions 20 collectively define a specific outline, and in the illustrated embodiment such outline is generally rectangular. As explained more fully below, this outline complements a similar outline in top lid member 14 to provide an interlocking fit when assembled food containers 10 are stacked one above the other.

Top lid member 14 includes a raised central portion 28 having an outline, in this case rectangular, substantially identical to but slightly smaller than the outline defined by the inside wall surfaces 24,26 of depressions 20. As shown best in FIGS. 5 and 6, the raised central portion 28 of top lid member 14 interlockingly fits between the inside wall surfaces of depressions 20 when assembled food containers 10 are stacked one above the other.

Moreover, top lid member 14 includes a plurality of vent openings 30 preferably located in the raised central portion 28. Also, it is preferred that raised central portion 28 include a depressed area 32 with the vent openings 30 located in that depressed area. In actual use, a gas permeable membrane (not shown) in the form of a label is positioned over the depressed area 32 to provide a controlled permeability to the various gases entering and exiting the container. The permeability of the membrane is selected in order to provide an ideal environment for the food product packaged in container 10. Water vapor and vapor pressure are similarly controlled by the label membrane. Also, since the vent openings 30 are recessed away from the membrane, any of the food product within the container that may be next to the vent openings is spaced away from the membrane label thereby preventing contamination of the membrane.

Figure 5:
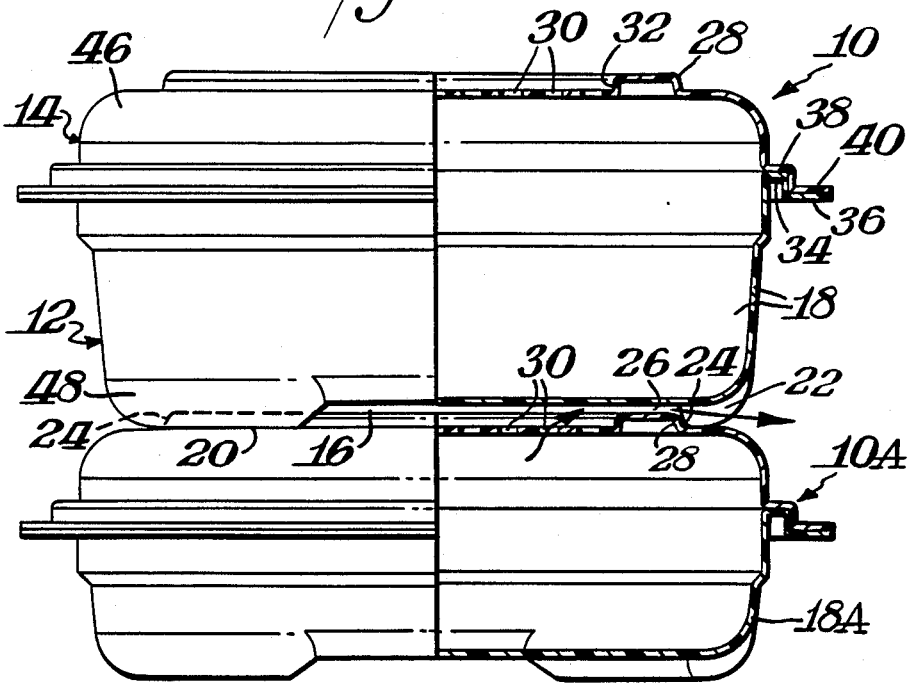
FIG. 5 is a side elevational view of two stacked food containers according to the present invention, with portions thereof shown in section to illustrate interior details.
Figure 6:
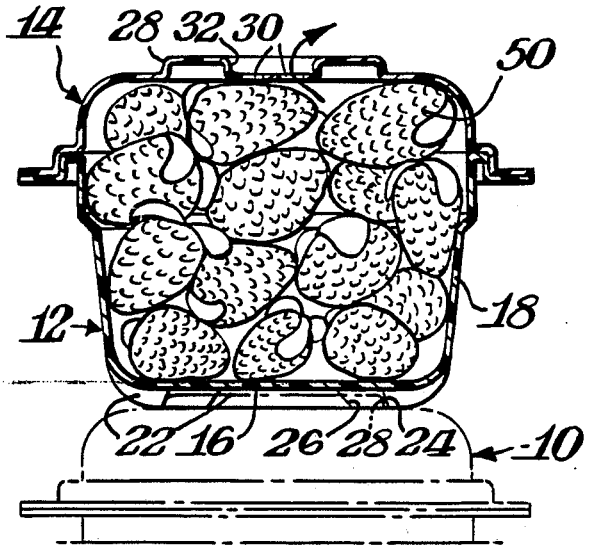
FIG. 6 is a sectional view taken along line 6—6 of FIG. 3, but also showing part of a second container in phantom outline.

FIGS. 5 and 6 best illustrate the profile between depressions 20 of bottom member 12 and the raised central portion 28 of top lid member 14. Essentially, the raised central portion has less vertical height when compared to the depressions and this relationship spaces the lower base wall 16 of bottom member 12 away from the raised central portion 28 of top lid member 14 when assembled food containers 10 are stacked one above the other. Preferably, raised central portion 28 is approximately one-third the height of depressions 20.

The overall effect of the openings 22 between depressions 20 and the spacing between lower base wall 16 and raised central portion 28 is the provision of flow passageways to the underside of stacked food containers 10. Gases may easily enter and exit the container through the vent openings 30 traveling along the passageways defined by lower base wall 16 and raised central portion 28. Such gases enter and exit via the openings 22 between the depressions.

Bottom member 12 includes a raised peripheral rim 34 and an outwardly extending peripheral flange 36. Similarly, top lid member 14 has a peripheral rim 38 which complements raised rim 34 of the bottom member. Top member 14 also includes an outwardly extending peripheral rim flange 40 that engages bottom rim flange 36 when the food containers are assembled. After the food product is positioned within the bottom member 12 and the top lid member 14 covers the bottom, the rim flanges 36, 40 may be releasably connected together by a heat seal. Alternatively, the mutually engagingly rim flanges may be releasably connected together by adhesive. Moreover, each rim flange may include a separation tab 42, 44 to facilitate removal of the top lid member from the bottom member. While top separation tab 42 mutually engages bottom separation tab 44, the tabs are not connected together during heat or adhesive sealing. The rim flanges are easily separated from one another by urging them in opposite directions away from one another.

It should be noted that easy separation of the bottom and top lid members of container 10 is assisted by the geometry of the inwardly positioned raised peripheral rim 34 and the complementary peripheral rim 38 of the top lid member. Basically flange 40 via tab 42 may be moved in an upward direction about the connection of that flange to peripheral rim 38. Similarly, lower flange 36 via tab 44 may be moved in a downward direction about its connection to raised peripheral rim 34. This stepped arrangement next to the mutually engaging flanges facilitates container separation.

Figure 1:
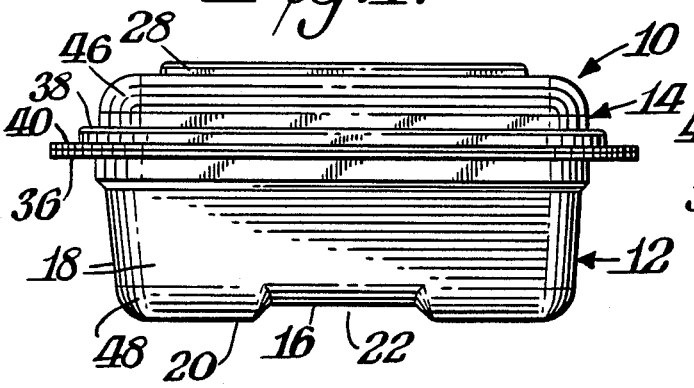
FIG. 1 is a side elevational view of a food container according to the present invention, it being understood that the opposite side thereof is substantially similar in appearance.
Figure 2:
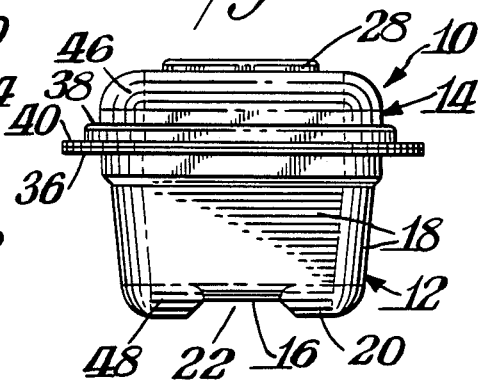
FIG. 2 is a right end elevational view of the food container shown in FIG. 1, it being understood that the left side thereof is substantially similar in appearance.

Depressions or container feet 20 include outside wall surfaces 48 which basically form extensions of surrounding wall 18, as best shown in FIGS. 1 and 2. Also, it should be noted that since these depressions are hollow they function as collection sites for any residual moisture associated with the food being packaged. Moreover, the top lid member 14 may include an upwardly extending dome 46 and the raised central portion 28 may extend upwardly from the dome. The domed top lid enables full appearance of the packaged food.

FIG. 5 shows two different size containers 10 and 10A. Container 10A is similar in all respects to container 10 except the surrounding side wall 18A has less height. These containers are particularly useful for packaging fresh produce such as mushrooms, broccoli florets, and the illustrated strawberries 50, for example.

What is claimed is:

1. A food container comprising a bottom member and a top lid member constructed and arranged to cover the bottom member when the members are assembled, the bottom member including a lower base wall and an upwardly extending side wall surrounding the base wall, a plurality of spaced apart downwardly extending depressions in the lower base wall, each of the depressions having an inside wall surface spaced inwardly from the surrounding side wall of the bottom member, the inside wall surfaces of the depressions in the lower base wall of the bottom member collectively defining an outline, the top lid member including a raised central portion having an outline substantially identical to but slightly smaller than the outline defined by the inside wall surfaces of the depressions whereby the raised central portion of the top lid member interlockingly fits between the inside wall surfaces of the depressions when assembled food containers are stacked one above the other, a depressed area in the raised central portion of the top lid member, a plurality of vent openings in the depressed area, and the raised central portion of the top lid member having less height than the depressions whereby the lower base wall of the bottom member is spaced from the raised central portion of the top lid member when assembled food containers are stacked one above the other thereby providing open passageways between the spaced apart depressions, the lower base wall of the bottom member and the raised central portion of the top lid member with the plurality of vent openings in the depressed area thereof.

2. A food container as in claim 1 wherein the lower base wall of the bottom member is generally rectangular and the spaced apart downwardly extending depressions therein are positioned at the corners of the lower base wall, one at each of the four corners thereof.

3. A food container as in claim 2 wherein each of the spaced apart downwardly extending depressions in the lower base wall of the bottom member is L-shaped.

4. A food container as in claim 1 wherein each of the spaced apart downwardly extending depressions in the lower base wall of the bottom member includes an outside wall surface, and wherein these outside wall surfaces form extensions of the surrounding side wall of the bottom member.

5. A food container as in claim 1 wherein the lower base wall of the bottom member is generally rectangular in configuration.

6. A food container as in claim 1 wherein the top lid member includes an upwardly extending dome and wherein the raised central portion extends upwardly from the dome.

7. A food container as in claim 1 wherein the outline collectively defined by the inside wall surfaces of the depressions in the base wall of the bottom member and the outline of the raised central portion of the top lid member are rectangular.

8. A food container as in claim 1 wherein the height of the raised central portion of the top lid member is approximately one-third the height of the depressions in the lower base wall of the bottom member.

9. A food container as in claim 1 wherein the bottom and top lid members include outwardly extending and mutually engaging peripheral rim flanges.

10. A food container as in claim 9 wherein the rim flanges are releasably connected together by a heat seal.

11. A food container as in claim 9 wherein the rim flanges are releasably connected together by adhesive.

12. A food container as in claim 9 wherein each of the mutually engaging rim flanges includes a separation tab to facilitate removal of the top lid member from the bottom member.

13. A food container as in claim 1 wherein the bottom and top lid members are fabricated from transparent polyvinyl chloride.

14. A food container as in claim 9 wherein the bottom member includes a raised peripheral rim adjacent its peripheral rim flange and the top lid member includes a complementary peripheral rim adjacent its peripheral rim flange.

* * * * *